US007699653B2

(12) United States Patent
Sakamoto et al.

(10) Patent No.: US 7,699,653 B2
(45) Date of Patent: Apr. 20, 2010

(54) RUBBER STOPPER FOR WATERPROOF CONNECTOR AND WATERPROOF CONNECTOR

(75) Inventors: Nobuyuki Sakamoto, Makinohara (JP); Keiko Ishida, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/187,968

(22) Filed: Aug. 7, 2008

(65) Prior Publication Data

US 2009/0042442 A1 Feb. 12, 2009

(30) Foreign Application Priority Data

Aug. 9, 2007 (JP) ..... 2007-207886

(51) Int. Cl.
*H01R 13/40* (2006.01)

(52) U.S. Cl. ..... 439/587; 439/272; 174/50; 174/92; 174/655

(58) Field of Classification Search ..... 439/587, 439/272, 274; 174/50, 655, 92
See application file for complete search history.

(56) References Cited

U.S. PATENT DOCUMENTS 3,576,937 A * 5/1971 Eldridge, Jr. ..... 174/92
4,229,616 A * 10/1980 Hotchkiss ..... 174/138 F
5,939,676 A * 8/1999 Birmingham et al. ..... 174/656
5,980,316 A 11/1999 Shinchi
6,180,882 B1 * 1/2001 Dinh ..... 174/655
6,325,661 B1 12/2001 Tabata
6,331,124 B1 12/2001 Miyazaki et al.
6,948,976 B2 * 9/2005 Goodwin et al. ..... 439/578
7,408,110 B2 * 8/2008 Schmidtpott et al. ..... 174/50
2006/0240710 A1 10/2006 Kato et al.

FOREIGN PATENT DOCUMENTS

JP 10-284168 A 10/1998
JP 2000-294336 10/2000
JP 2000-323229 A 11/2000
JP 2006-302850 A 11/2006

* cited by examiner

*Primary Examiner*—Truc T Nguyen
(74) *Attorney, Agent, or Firm*—Sughrue Mion, PLLC

(57) ABSTRACT

A rubber stopper for a waterproof connector includes: a first elastic member including a first contact face, and first wire fitting grooves each having an arc cross-section; and a second elastic member including a second contact face and second wire fitting grooves each having an arc cross-section. When the first contact face contacts the second contact face, circular cross-section is formed by the arc cross-sections of the first and second wire fitting grooves to fit wires into the first and second wire fitting grooves. Arc length of the arc cross-section of the first wire fitting groove is different from arc length of the arc cross-section of the second wire fitting groove so that a center of the circular cross-section is disposed away from the first and second contact faces in a direction perpendicular to an extending direction of the first and the second contact faces.

4 Claims, 4 Drawing Sheets

RUBBER STOPPER FOR WATERPROOF CONNECTOR AND WATERPROOF CONNECTOR

BACKGROUND OF THE INVENTION

1. Technical Field

The present invention relates to a rubber stopper for a waterproof connector for the purpose of waterproofing electric wires which are equipped with terminal clamps at their ends, from an inlet side where the electric wires are inserted into the connector, and the waterproof connector employing this rubber stopper.

2. Background Art

Various electrical appliances are mounted on a vehicle body of an automobile. For the purpose of supplying electric power for actuating these electrical appliances, and sending control signals, there is arranged a wire harness including a number of electric wires bundled. A connector for connecting the electric wires to the electrical appliances is provided at an end of the wire harness. This connector generally includes terminal clamps formed of metal having favorable electrical conductivity, an insulating connector housing for containing a plurality of the terminal clamps connected to core wires of the electric wires, and so on. Moreover, the connector has a cylindrical shape or a box-like shape.

Recently, in view of diversification of customers' needs and in order to improve global environment, variety of the above described electrical appliances to be mounted has more and more increased, and accordingly, high reliability, lightweight, versatility, and compactness of the electrical appliances has been more keenly required. Particularly, there is a tendency to concentrate an ECU (Electronic Control Unit) in an engine room. In case where the ECU is concentrated in the engine room, it is a serious problem to secure heat resistance of various constituent elements of the electrical appliances, such as an IC, and to reliably secure waterproofing performance against rainwater, car wash, etc.

As a waterproof connector for securing the waterproofing performance of the above described problem, a waterproof connector employing a pair of rubber stoppers in a two split mold which are provided with arc-shaped fitting grooves for fitting the electric wires has been heretofore proposed. The waterproof connector of this type employing the rubber stoppers in the two split mold is disclosed in the following patent documents, for example.

[Patent Document 1] JP-A-10-284168

[Patent Document 2] JP-A-2000-323229

[Patent Document 3] JP-A-2006-302850

In the aforesaid Patent Document 1, there is proposed a waterproof connector including a connector body which contains a plurality of terminal clamps connected to electric wires and arranged in parallel, and a rubber plug which is fitted to a recessed part provided on a connection side of the electric wires. The rubber plug is provided with wire fitting grooves for respectively fitting half peripheral parts of the electric wires, on respective contact faces of a pair of split mold bodies which are formed in the two split mold. It is further disclosed that rubber plug pressing grooves are provided at an intermediate position between the two adjacent wire fitting grooves on the outer peripheral surface of the rubber plug, and pressing ribs adapted to be engaged with these rubber plug pressing grooves are provided on an inner face of the recessed part of the connector body. It is further described, in Patent Document 1, that when the rubber plug consisting of a pair of the split mold bodies having the electric wires inserted into the wire fitting grooves is fitted into the recessed part of the connector body, the pressing ribs are engaged with the rubber plug pressing grooves to further compress the rubber plug, whereby waterproofing performance of contact parts between the electric wires and the split mold bodies of the rubber plug is improved.

In the aforesaid Patent Document 2, there is proposed a rubber plug in a two split mold formed with electric wire insertion holes having a semicircular sectional shape into which electric wires equipped with terminal clamps are inserted. It is disclosed that this rubber plug in the two split mold is divided at a plane traversing the electric wire insertion holes, and coupled by a hinge so as to be opened and closed. For assembling this rubber plug, as a first step, the terminal clamps connected to the electric wires are inserted into cavities in a housing. Then, the electric wires are clamped by the electric wire insertion holes of the rubber plug in the two split mold, and thereafter, the rubber plug in a closed state is fitted into a common inlet of the housing.

In the aforesaid Patent Document 3, there is proposed a waterproof packing in a two split mold which is coupled by a hinge at one side and provided with electric wire insertion holes having a semicircular sectional shape on inner faces of the waterproof packing which form contact faces, wherein a thermoplastic adhesive is further adhered to the contact faces, the electric wire insertion holes and an outer peripheral faces of the waterproof packing. In the invention disclosed in Patent Document 3, the waterproof packing in the two split mold having the electric wires equipped with the terminal clamps inserted into the wire insertion holes is inserted into an outer housing of a waterproof connector, and heat is added to the thermoplastic adhesive from outside, whereby the thermoplastic adhesive which is adhered to the wire insertion holes is melted thereby to bond and fix outer peripheral faces of the electric wires to inner peripheral faces of the wire insertion holes.

At the same time, the thermoplastic adhesive adhered to the outer peripheral face of the waterproof packing is also melted thereby to bond and fix the outer peripheral face of the waterproof packing to an inner peripheral face of a packing container in the outer housing, whereby waterproofing performance between the electric wires and a mounting side of the connector housing is enhanced.

The rubber plug (or the waterproof packing) in the two split mold as is disclosed in the aforesaid Patent Documents 1 to 3 is equally divided in two, and so, the wire insertion holes for clamping the electric wires which are formed on the contact faces have a semicircular shape in cross section. This will be described referring to FIGS. 6A and 6B. Wire insertion holes 23*a* . . . 23*b* . . . which are formed between contact faces 22*a*, 22*b* of a pair of upper and lower rubber plugs (rubber stoppers) 21*a*, 21*b* have a semicircular or a substantially semicircular shape. Therefore, when the contact faces of a pair of the upper and lower rubber plugs 21*a*, 21*b* contact each other, after electric wires 24 having a circular sectional shape have been inserted into spaces in a cylindrical shape which are formed by the opposed wire insertion holes 23*a* and 23*b*, there has been such possibility that positional deviations 25 may occur on the contact faces 22*a*, 22*b* between the adjacent wire insertion holes 23*a* or 23*b*, as shown in FIG. 6B.

The reason why the positional deviations 25 occur on the contact faces 22*a*, 22*b* of the conventional rubber stoppers 21*a*, 21*b* in the two split mold is as follows. Operation for inserting the electric wires 24 into the wire insertion holes 23*a* . . . , 23*b* . . . which are formed on the contact faces 22*a*, 22*b* of the rubber stoppers 21*a*, 21*b* in the two split mold is conducted in the following manner.

As a first step, the electric wires 24 are inserted into the wire insertion holes 23*b* . . . of the rubber stopper 21*b* at a lower side, as shown in FIG. 6A, and thereafter, the rubber stopper 21*a* at an upper side is mated to the rubber stopper 21*b* at the lower side. Because the wire insertion holes 23*a* formed in the upper rubber stopper 21*a* have a semicircular or a substantially semicircular shape, an area where the semicircular-shaped parts come into contact with surfaces of the electric wires 24 is increased, when conducting this operation for mating the upper rubber stopper 21*a* to the lower rubber stopper 21*b*, after the electric wires 24 have been inserted into the wire insertion holes 23*b* of the lower rubber stopper 21*b*. Therefore, there has been such a risk that the positional deviations 25 may occur due to contact resistance between the wire insertion holes 23*a* and the surface of the electric wires 24. When such positional deviations 25 as shown in FIG. 6B have occurred, gaps are formed between the contact faces 22*a*, 22*b* of the rubber stoppers 21*a*, 21*b* in the two split mold, and waterproofing performance will be deteriorated.

SUMMARY OF THE INVENTION

In view of the circumstances, an object of the invention is to provide a rubber stopper for a waterproof connector in which the rubber stopper including a pair of split mold bodies is employed and occurrence of such inconveniences as in the aforesaid related art is prevented, and the waterproof connector provided with this rubber stopper.

In order to attain the above described object, there is provided according to the invention, a rubber stopper for a waterproof connector, including:

a first elastic member including a first contact face, and first wire fitting grooves each having an arc cross-section; and a second elastic member including a second contact face and second wire fitting grooves each having an arc cross-section, wherein when the first contact face contacts the second contact face, circular cross-section is formed by the arc cross-sections of the first and second wire fitting grooves to fit wires into the first and second wire fitting grooves; and wherein arc length of the arc cross-section of the first wire fitting groove is different from arc length of the arc cross-section of the second wire fitting groove so that a center of the circular cross-section is disposed away from the first and second contact faces in a direction perpendicular to an extending direction of the first and the second contact faces.

Further, according to the invention, the rubber stopper further includes a third elastic member including a third contact face, and third wire fitting grooves each having an arc cross-section, and a fourth contact face, and fourth wire fitting grooves each having an arc cross-section are provided on an opposed surface of the first or second contact faces, when the third contact face contacts the fourth contact face, circular cross-section is formed by the arc cross-sections of the third and fourth wire fitting grooves, and arc length of the arc cross-section of the third wire fitting groove is different from arc length of the arc cross-section of the fourth wire fitting groove so that a center of the circular cross-section is disposed away from the third and fourth contact faces in a direction perpendicular to an extending direction of the third and the fourth contact faces.

Still further, the first contact face has one of a convex part and a concave part, and the second contact face has the other of the convex part and the concave part to be fixed into the one of the convex part and the concave part.

Moreover, a waterproof connector according to the invention includes a connector housing into which the wires equipped with terminal clamps are inserted, and the connector housing includes a rubber stopper container into which the rubber stopper as mentioned above is inserted.

The rubber stopper for the waterproof connector according to the invention is constructed in such a manner that when the electric wire is clamped by the wire fitting grooves which are formed on the contact faces of a pair of the split mold bodies formed of elastic material, a center part of the clamped electric wire is separated by a determined distance in a up/down direction from the contact faces of a pair of the split mold bodies. As the results, it is possible to rigidly hold the electric wire in tight contact over its surface area exceeding a half peripheral part thereof, by the split mold body in which the wire fitting groove having a longer arc-shaped part in cross section is formed. At the same time, the contact faces of a pair of the split mold bodies positioned between the adjacent wire fitting grooves can be made longer, as compared with the conventional rubber stopper which is equally divided in two, and hence, waterproofing effect between the contact faces of the split mold bodies can be enhanced.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1A:
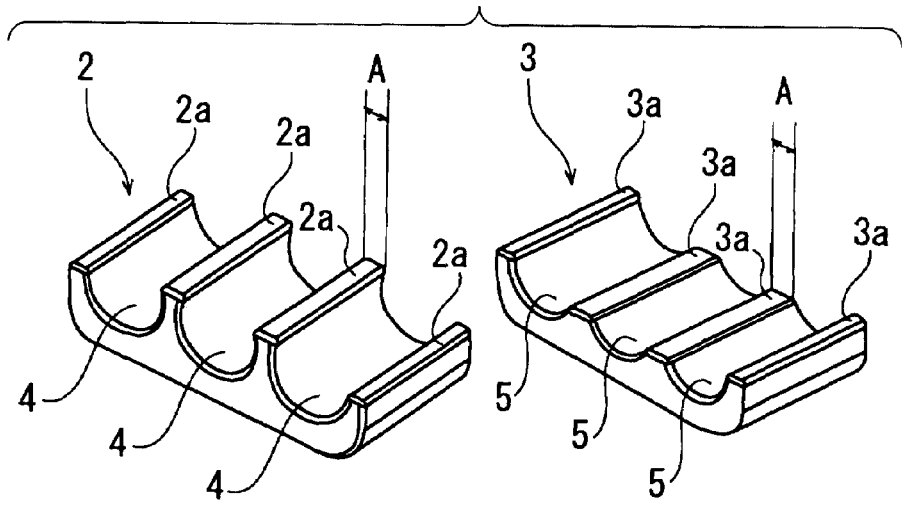
FIG. 1A is an exploded perspective view for describing a structure of the rubber stopper for the waterproof connector according to an embodiment of the invention.

Now, embodiments of the invention will be described referring to the drawings. FIG. 1A is a perspective view showing a rubber stopper for a waterproof connector including a pair of split mold bodies in an embodiment according to the invention, and FIG. 1B is a side view showing a state where electric wires are clamped by the rubber stopper for the waterproof connector including a pair of the split mold bodies.

Figure 1B:
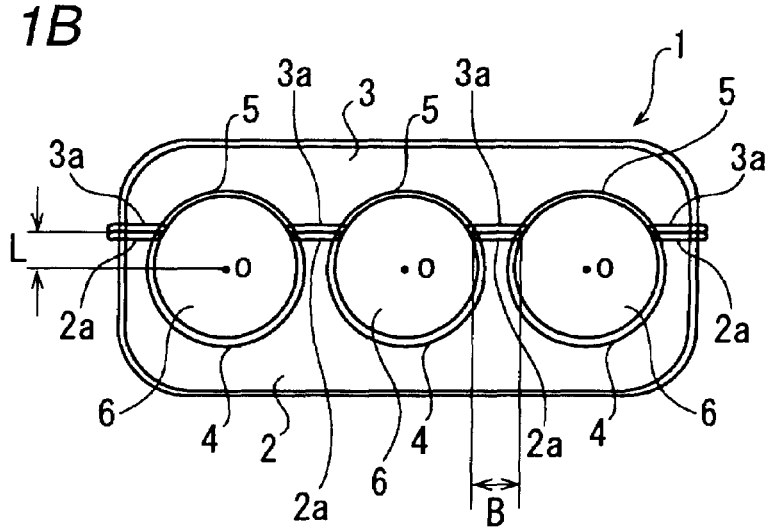
FIG. 1B is a side view for describing the structure of the rubber stopper for the water proof connector according to the invention in a state where electric wires are clamped by wire fitting grooves.

A rubber stopper 1 for a waterproof connector as shown in FIGS. 1A and 1B includes a pair of an upper split mold body 2 and a lower split mold body 3. A plurality of wire fitting grooves 4 and 5 having an arc-like shape in cross section are provided in parallel at a determined interval so as to be opposed to each other, on opposed faces (hereinafter, referred to as contact faces) 2*a*, 3*a* of the upper and lower split mold bodies 2, 3 to be mated. These wire fitting grooves 4, 5 are formed in such a manner that when the contact faces 2*a*, 3*a* of the upper and lower split mold bodies 2,3 have been mated, the opposed wire fitting grooves 4, 5 are positioned (opposed) so as to form a circular shape or a substantially circular shape in cross section. A diameter of the circular sectional shape which is formed by the wire fitting grooves 4, 5 when the upper and lower split mold bodies 2, 3 have been mated is set to be smaller than a diameter of an electric wire 6 to be inserted into the wire fitting grooves 4, 5. As shown in FIG. 1A, the contact faces 2*a*, 3*a* of the upper and lower split mold bodies 2, 3 are in a form of a flat contact face having a width A.

The rubber stopper 1 for a waterproof connector according to the invention including a pair of the aforesaid upper and lower split mold bodies 2, 3 is characterized in that a plurality of the wire fitting grooves 4, 5 having the arc-like shape in cross section respectively formed on the contact faces 2*a*, 3*a* of the split mold bodies 2, 3 are different from each other in the sectional shape, as shown in FIG. 1B. Specifically, a length of an arc-shaped part of the wire fitting groove which is formed on the contact face of one of the split mold bodies 2, 3 is made larger than a length of an arc-shaped part of the wire fitting groove which is formed on the contact face of the other split mold body.

In other words, when the upper and lower split mold bodies 2, 3 have been mated at the contact faces 2, 3, a center position O of a circular sectional shape formed by the opposed wire fitting grooves 4, 5 (corresponding to a center position of the electric wire 6 which has been inserted into the wire fitting grooves 4, 5) is set at a position separated from the contact face 2*a* or 3*a* by a determined distance L in up/down direction, as shown in FIG. 1B.

In an example as shown in FIG. 1B, the length of the arc-shaped part in cross section of the wire fitting groove 4 which is formed in the split mold body 2 arranged at a lower side of a pair of the upper and lower split mold bodies 2, 3 is made larger than the length of the arc-shaped part in cross section of the wire fitting groove 5 which is formed in the split mold body 3 arranged at an upper side. In short, the center position O of the circular shape in cross section which is formed by the opposed wire fitting grooves 4, 5 is at a position separated from the contact face 2*a* or 3*a* by the distance L.

A pair of the upper and lower split mold bodies 2, 3 which compose the rubber stopper 1 for a waterproof connector can be formed of elastic material having a determined collapsing allowance, for example, synthetic resin such as is silicone rubber material, fluorine rubber material, acryl rubber material, etc. Moreover, the split mold bodies 2, 3 can be produced from the synthetic resin material by injection molding.

Then, operation of the above described rubber stopper 1 for the waterproof connector in an embodiment will be described. FIG. 1B shows a state where the electric wires 6 equipped with terminal clamps are inserted into the wire fitting grooves 4, 5 which are formed on the contact faces of the upper and lower split mold bodies 2, 3, and clamped by the upper and lower split mold bodies 2, 3. When operation for assembling the waterproof connector is conducted, this rubber stopper 1 for the waterproof connector is press-fitted into a rubber plug container which is provided in a housing of the waterproof connector.

Operation for inserting the electric wires 6 equipped with the terminal clamps into the wire fitting grooves 4, 5 of the split mold bodies 2, 3 can be carried out according to the following steps 1 to 2.

(Step 1)

As a first step, the electric wires 6 are inserted into the wire fitting grooves 4 which are formed in the lower split mold body 2 out of a pair of the upper and lower split mold bodies 2, 3 which compose the rubber stopper 1 for the waterproof connector as shown in FIG. 1B. Although an opening of each the wire fitting groove 4 in the lower split mold body 2 is smaller than a diameter of a semicircle, the electric wire 6 can be inserted into the wire fitting groove 4 because of appropriate elasticity of the rubber stopper 1 for the waterproof connector. On this occasion, a part of the electric wire 6 which has been inserted into the wire fitting groove 4 is exposed from the contact face 2*a* of the lower split mold body 2.

(Step 2)

Then, the wire fitting groove 5 formed in the upper split mold body 3 is put on the electric wire 6 which is exposed from the contact face 2*a*, whereby mating of the upper and lower split mold bodies 2, 3 is conducted.

In the above described step (1), the arc-shaped part in cross section of the wire fitting groove 4 which is formed in the lower split mold body 2 is set to be longer than the arc-shaped part in cross section of the wire fitting groove 5 which is formed in the upper split mold body 3. Therefore, it is possible to stably clamp a part exceeding a half periphery of an outer peripheral face of the electric wire which has been inserted into the wire fitting groove 4.

Figure 6A:
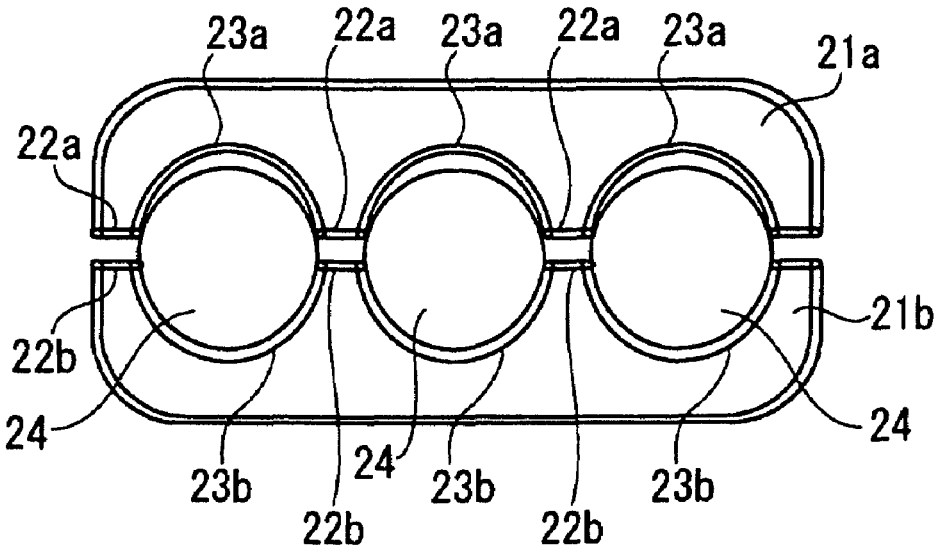
FIG. 6A PRIOR ART
FIG. 6A is a side view for describing a structure of a conventional rubber stopper for a waterproof connector.
Figure 6B:
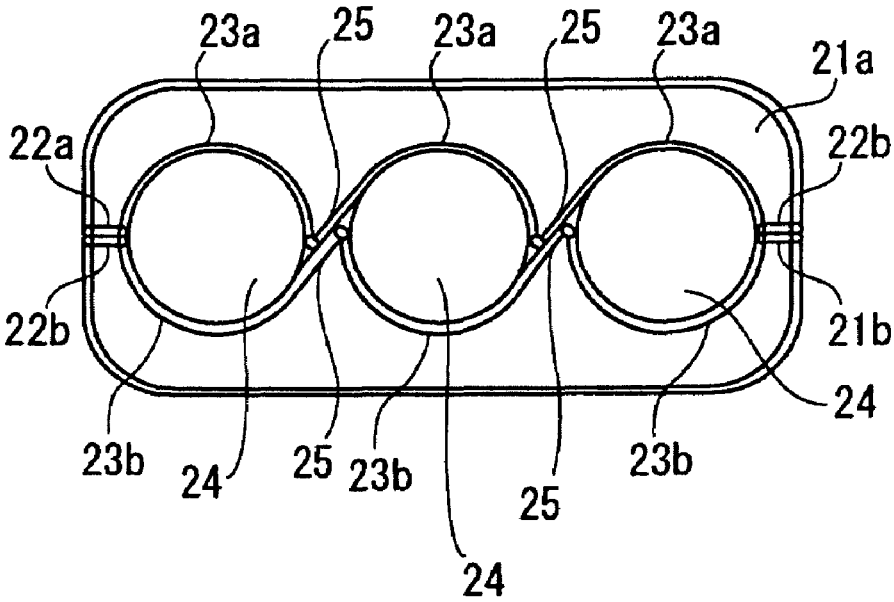
FIG. 6B PRIOR ART
FIG. 6B is a side view for describing occurrence of deviations on contact faces when the electric wires are inserted into the wire fitting grooves in the structure of the conventional rubber stopper for the waterproof connector.

As described above, the arc-shaped part in cross section of the wire fitting groove 5 which is formed in the upper split mold body 3 is set to be shorter than the arc-shaped part of the semicircular shape. Therefore, in the above described step (2), the operation for putting the wire fitting groove 5 which is formed in the upper split mold body 3 on the electric wire 6 which is exposed from the contact face 2*a* of the lower split mold body 2 can be very easily performed, without applying a pressure. As the results, it is possible to prevent occurrence of the aforesaid positional deviations 25 (See FIG. 6B) between the contact faces 2*a*, 3*a* of a pair of the upper and lower split mold bodies 2, 3.

Figure 2:
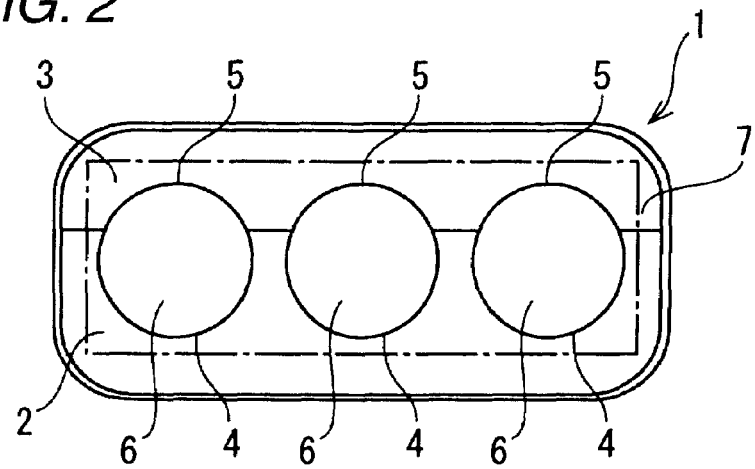
FIG. 2 is a side view for describing the structure of the rubber stopper for the waterproof connector according to the invention in a state where it is inserted into a rubber stopper container of the waterproof connector.

FIG. 2 shows a pair of the upper and lower split mold bodies 2, 3 (the rubber stopper 1 for the waterproof connector) in which the electric wires 6 equipped with the terminal clamps are clamped between the wire fitting grooves 4, 5, in a state where they have been press-fitted into a rubber plug container 7 (shown by a phantom line) provided in a connector housing which is a main body of the waterproof connector. As shown in FIG. 2, the rubber stopper 1 for the waterproof connector which is contained in the rubber plug container 7 is compressed and elastically deformed so that its outer peripheral face may fit to a shape of an inner peripheral face of the rubber plug container 7 and come into tight contact with the inner peripheral face of the rubber plug container 7. Following this elastic deformation, the contact faces 2*a*, 3*a* and the wire fitting grooves 4, 5 of a pair of the upper and lower split mold bodies 2, 3 are also elastically compressed, and therefore, the contact faces 2*a*, 3*a*, the wire fitting grooves 4, 5, and the outer peripheral faces of the electric wires 6 are brought into tight contact to each other without any gap, whereby high waterproofing effect can be obtained.

As described above, the contact face 2*a* (3*a*) is separated from the center position O of the circle in cross section formed by the wire fitting grooves 4, 5, by the distance L. It is desirable to set this distance L so as to satisfy A−B<=0.6 mm, provided that A is a width of the contact face 2*a* (3*a*) of the upper and lower split mold bodies 2, 3, and B is a distance between the electric wires 6 when the electric wires 6 have been inserted into the wire fitting grooves 4. The reason why is because workability of fitting the electric wires 6 into the wire fitting grooves 4 is deteriorated, in case where the width A is too large, although contact effect between the contact faces 2*a*, 3*a* is enhanced by setting the width A as large as possible. Therefore, it would be desirable to set this distance L so as to satisfy A−B<=0.6 mm.

In case where the rubber stopper 1 for the waterproof connector according to the invention is applied to the waterproof connector in which the electric wires 6 equipped with the terminal clamps are contained in a matrix form in both vertical and lateral directions, the following structure, for example, can be employed. As shown in an exploded front view in FIG. 3, a determined number of intermediate rubber stoppers 10*a*, 10*b*, 10*c* may be arranged between a pair of the upper and lower split mold bodies 2, 3. The intermediate rubber stoppers 10*a*, 10*b*, 10*c* are in the same shape and formed of elastic material such as silicone rubber material, fluorine rubber material, silicone rubber material, etc. in the same manner as the upper and lower split mold bodies 2, 3.

Figure 3:
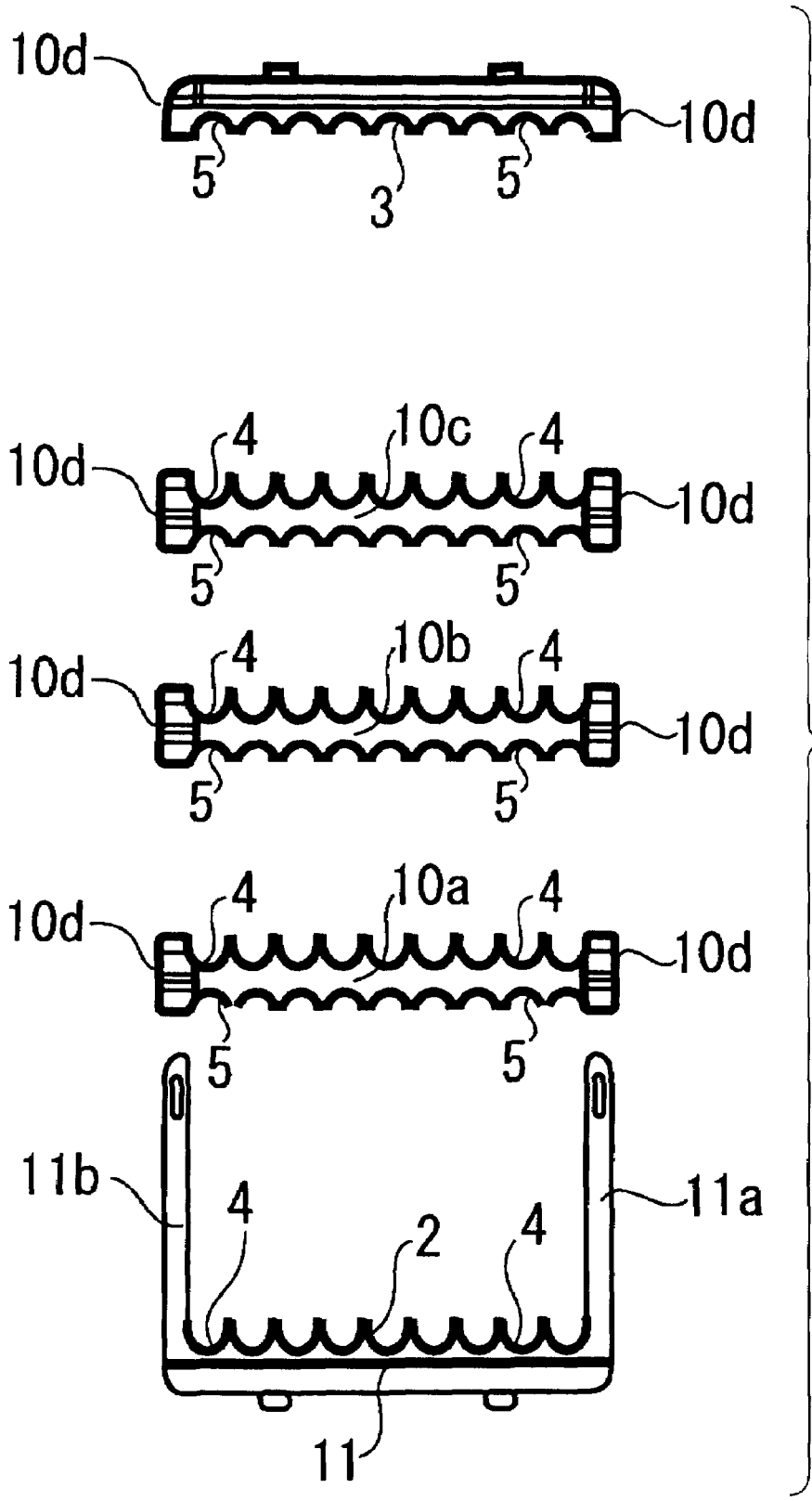
FIG. 3 is an exploded perspective view for describing a structure of the rubber stopper for the waterproof connector according to the invention in another embodiment.

As shown in FIG. 3, the wire fitting grooves 5 are formed at a determined interval on contact faces of the intermediate rubber stoppers 10*a*, 10*b*, 10*c* at a lower side, in the same matter as the contact face 3*a* of the split mold body 3 as shown in FIG. 1. In short, the wire fitting groves 5 as shown in FIG. 3 correspond to the wire fitting grooves 5 in FIG. 1. Moreover, the wire fitting grooves 5 formed on the lower contact faces of the intermediate rubber stoppers 10*a*, 10*b*, 10*c* are provided at positions opposed to the wire fitting grooves 4 which are formed on the contact face of the lower split mold body 2 as shown in FIG. 3.

In the same manner, the wire fitting grooves 4 are formed at a determined interval on contact faces of the intermediate rubber stoppers 10*a*, 10*b*, 10*c* at an upper side, in the same manner as the contact face 2*a* of the split mold body 2 as shown in FIG. 1. In short, the wire fitting groves 4 as shown in FIG. 3 correspond to the wire fitting grooves 4 in FIG. 1. Moreover, the wire fitting grooves 4 formed on the upper contact faces of the intermediate rubber stoppers 10*a*, 10*b*, 10*c* are provided at positions opposed to the wire fitting grooves 5 which are formed on the contact face of the upper split mold body 3 as shown in FIG. 3.

Further, locking members 10*d* are fixed to opposite ends of the intermediate rubber stoppers 10*a*, 10*b*, 10*c*. Further, the split mold body 2 at the lower side is fixed to a rubber stopper locking frame 11 provided with two locking struts 11*a*, 11*b* which are uprightly extended from both side ends thereof.

In case of waterproofing the electric wires 6 equipped with the terminal clamps, by employing the rubber stopper 1 for the waterproof connector having the structure as shown in FIG. 3, the rubber stopper 1 can be assembled according to the following steps 3 to 7.

(Step 3)

The electric wires 6 are inserted into the wire fitting grooves 4 which are formed in the lowermost split mold body 2. Although an opening of each the wire fitting groove 4 in the lower split mold body 2 is smaller than a diameter of a semicircle, the electric wire 6 can be inserted into the wire fitting groove 4 because of appropriate elasticity of the rubber stopper 1 for the waterproof connector. On this occasion, a part of the electric wire 6 which has been inserted into the wire fitting groove 4 is exposed from the contact face 2*a* of the lower split mold body 2.

(Step 4)

Then, the wire fitting grooves 5 formed on the contact face at the lower side of the intermediate rubber stopper 10*a* are put on the electric wires 6 which are exposed from the contact face 2*a* out of the electric wires 6 which have been inserted into the wire fitting grooves 4 of the lower split mold body 2 in the step 3, and the split mold body 2 is mated to the lower face of the intermediate rubber plug 10*a*. In this manner, the electric wires 6 can be contained in tight contact inside the parts having a circular sectional shape formed by the opposed wire fitting grooves 4, 5. On this occasion, the locking members 10*d* fixed to the opposite ends of the intermediate rubber body 10*a* slide between the two locking struts 11*a*, 11*b* so that the intermediate rubber body 10*a* may be tightly contacted with the lower split mold body 2.

(Step 5)

Then, the electric wires 6 are inserted into the wire fitting grooves 4 which are formed on the upper face of the intermediate rubber body 10*a* which has been brought into tight contact with the lower split mold body 2 in the step 4.

(Step 6)

Then, the wire fitting grooves 5 formed on the contact face at the lower side of the intermediate rubber stopper 10*b* are put on the electric wires 6 which are exposed from the upper contact face of the intermediate rubber stopper 10*a* out of the electric wires 6 which have been inserted into the wire fitting grooves 4 on the upper face of the intermediate rubber stopper 10*a* in the step 5, and the upper face of the intermediate rubber plug 10*a* is mated to the lower face of the intermediate rubber stopper 10*b*. In this manner, the electric wires 6 can be contained in tight contact inside the parts having a circular sectional shape formed by the opposed wire fitting grooves 4, 5. On this occasion, in the same manner as described above, the locking members 10*d* fixed to the opposite ends of the intermediate rubber body 10*b* slide between the two locking struts 11*a*, 11*b* so that the intermediate rubber body is 10*b* may be tightly contacted with the intermediate rubber stopper 10*a*.

(Step 7)

Then, following the same steps, the intermediate rubber stopper 10*c* is tightly fitted to the upper contact face of the intermediate rubber stopper 10*b*, and further, the uppermost split mold body 3 is tightly fitted to the upper contact face of the intermediate rubber stopper 10*c*. In this manner, it is possible to form a waterproof mechanism in which the electric wires 6 equipped with the terminal clamps are clamped by the rubber stopper 1 for the waterproof connector in a matrix shape.

In the embodiment of the rubber plug 1 for the waterproof connector as shown in FIG. 3, the respective opposite sides of the upper and lower split mold bodies 2, 3, and the intermediate rubber stoppers 10*a*, 10*b*, 10*c* are fixed by the locking struts 11*a*, 11*b*. As the results, it is possible to prevent positional deviations of these split mold bodies 2, 3, and the intermediate rubber stoppers 10*a*, 10*b*, 10*c*, when they are assembled.

Figure 4:
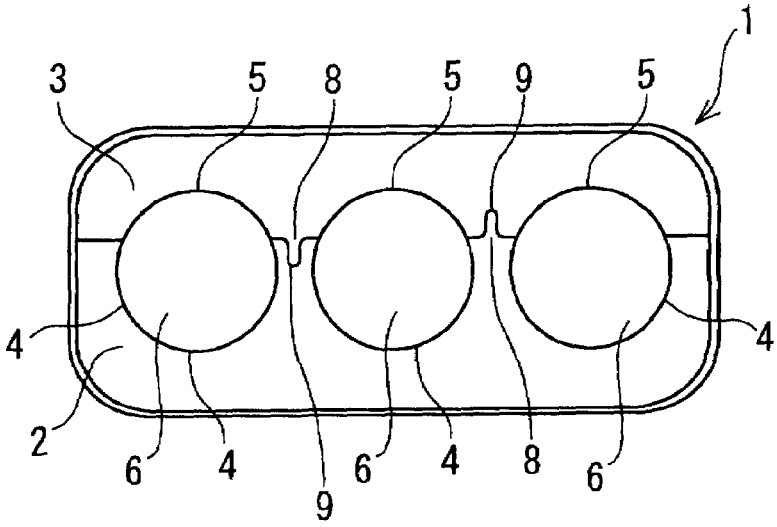
FIG. 4 is a side view for describing a structure of the rubber stopper for the waterproof connector according to the invention in still another embodiment.

Then, referring to FIG. 4, another embodiment of the rubber stopper for the waterproof connector according to the invention will be described. The embodiment as shown in FIG. 4 is characterized in that convex parts 8 projecting in a vertical direction and concave parts 9 recessed in the same vertical direction are provided between the adjacent wire fitting grooves on the contact faces 2*a*, 3*a* of the upper and lower split mold bodies 2, 3, and when the upper and lower split mold bodies 2, 3 are mated along the contact faces 2*a*, 3*a*, the convex parts 8 provided on the one contact face 2*a* are engaged with the concave parts 9 provided on the other contact face 3*a*. It is preferable that the convex parts 8 and the concave parts 9 are formed along an entire length in the longitudinal direction of the contact faces 2*a*, 3*a* of the split mold bodies 2, 3, that is, in the longitudinal direction of the electric wires 6.

In the embodiment as shown in FIG. 4, the convex part 8 and the concave part 9 are provided on the contact face 2*a* of the lower split mold body 2, while the concave part 9 and the convex part 8 adapted to be engaged with the convex part 8 and the concave part 9 which are provided on the contact face 2*a* of the lower split mold body 2 are provided on the contact face 3*a* of the upper split mold body 3. However, it is also possible to provide the concave parts 9 on the contact face 2*a* of the lower split mold body 2, while the convex parts 8 are provided on the contact face 3*a* of the upper split mold body 3. Moreover, although not shown in FIG. 4, it is also possible to provide the aforesaid convex parts 8 and concave parts 9 at both opposite ends of the contact faces of the upper and lower split mold bodies 2, 3.

In the rubber stopper 1 for the waterproof connector as shown in FIG. 4, when the electric wires 6 are inserted into the wire fitting grooves 4 formed on the contact face 2*a*, a laterally extending stress is exerted on the lower split mold body 2, whereby a width of the concave part 9 which is formed on the contact face 2*a* of the lower split mold body 2 is reduced. Then, the wire fitting grooves 5 formed in the upper split mold body 3 are put on the electric wires 6 which are exposed from the contact face 2*a*, and the aforesaid convex parts 8 and concave parts 9 are respectively engaged thereby to mate the upper and lower split mold bodies 2, 3. On this occasion, the contact faces 2*a* and 3*a* of the upper and lower split mold bodies 2, 3 are rigidly contacted with each other, and waterproofing effect between the contact faces 2*a* and 3*a* can be further improved.

Figure 5:
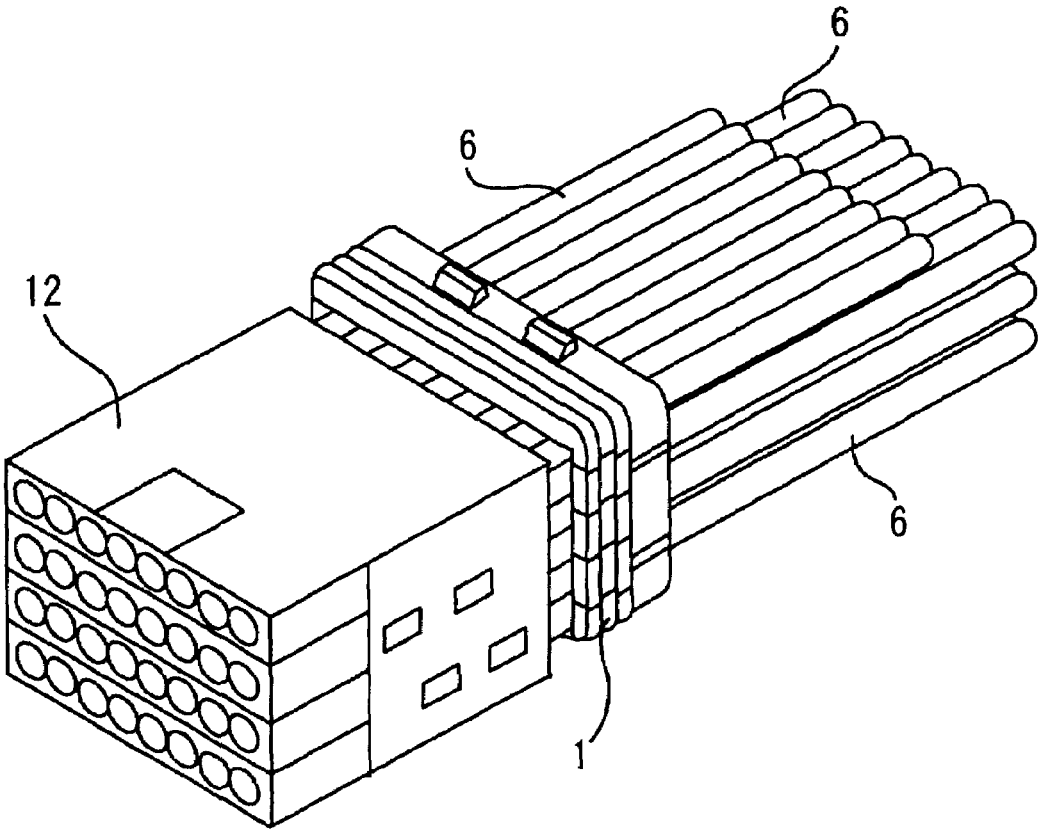
FIG. 5 is a perspective view for describing an example of a structure of the waterproof connector in which the rubber stopper for the waterproof connector according to the invention is employed.

Then, referring to FIG. 5, a structure of the waterproof connector employing the rubber stopper 1 for the waterproof connector according to the invention will be described. FIG. 5 is a perspective view showing a state where the electric wires 6 equipped with the terminal metals (not shown) are clamped by the rubber stopper 1 for the waterproof connector according to the invention, and inserted into a rubber plug container which is provided in a connector housing of a waterproof connector 12 formed of synthetic resin. Although not shown in the drawing, terminal containing chambers which contain the terminal clamps connected to the electric wires 6 are arranged in a matrix form both in the vertical and lateral direction, in the connector housing of the waterproof connector 12.

Operation for assembling the waterproof connector as shown in FIG. 5 can be conducted according to the following steps, for example.

(1) As a first step, the terminal clamps connected to the electric wires 6 are respectively inserted into the terminal containing chambers which are provided in the connector housing of the waterproof connector 12.

(2) Then, the electric wires 6 equipped with the terminal clamps are clamped by the rubber stopper 1 for the waterproof connector according to the aforesaid steps 3 to 7.

(3) Thereafter, the rubber stopper 1 for the waterproof connector is inserted into the rubber stopper container which is provided at an inlet of the connector housing of the waterproof connector 12. The waterproof connector as shown in FIG. 5 can be assembled according to the above described steps 1 to 3.

In the above described embodiment as shown in FIG. 3, in case where the lower split mold body 2, the intermediate rubber stoppers 10*a*, 10*b*, 10*c*, and the upper split mold body 3 are superposed in the vertical direction to form a laminated structure, it is possible to apply an adhesive agent formed of thermosetting resin or the like to the opposed contact faces thereby to bond these contact faces, so that the waterproofing performance may be further enhanced.

Further, although the case wherein the split mold bodies 2, 3, and the intermediate rubber stoppers 10*a*, 10*b*, 10*c* which compose the rubber stopper for the waterproof connector according to the invention are formed of elastic material such as silicone rubber material, fluorine rubber material, acryl rubber material has been described, the rubber stopper for the waterproof connector according to the invention may be formed in the following manner. Specifically, the split mold bodies 2, 3, and the intermediate rubber stoppers 10*a*, 10*b*, 10*c* may be formed of hard synthetic resin. Then, elastic seal coating layers formed of silicone rubber material, fluorine rubber material, acryl rubber material etc. may be formed on surfaces of the split mold bodies 2, 3 and the intermediate rubber stoppers 10*a*, 10*b*, 10*c* which are formed of the hard synthetic resin thereby to form the rubber stopper for the waterproof connector.

What is claimed is:

1. A rubber stopper for a waterproof connector, comprising:

a first elastic member including a first contact face, and first wire fining grooves each having an arc cross-section; and a second elastic member including a second contact face and second wire fitting grooves each having an arc cross-section, wherein when the first contact face contacts the second contact face, circular cross-section is formed by the arc cross-sections of the first and second wire fitting grooves to fit wires into the first and second wire fining grooves; and wherein arc length of the arc cross-section of the first wire fining groove is different from arc length of the arc cross-section of the second wire fining groove so that a center of the circular cross-section is disposed away from the first and second contact faces in a direction perpendicular to an extending direction of the first and the second contact faces.

2. The rubber stopper as claimed in claim 1, further comprising:

a third elastic member including a third contact face, and third wire fitting grooves each having an arc cross-section, wherein a fourth contact face, and fourth wire fitting grooves each having an arc cross-section are provided on an opposed surface of the first or second contact faces;

wherein when the third contact face contacts the fourth contact face, circular cross-section is formed by the arc cross-sections of the third and fourth wire fitting grooves; and wherein arc length of the arc cross-section of the third wire fitting groove is different from arc length of the arc cross-section of the fourth wire fitting groove so that a center of the circular cross-section is disposed away from the third and fourth contact faces in a direction perpendicular to an extending direction of the third and the fourth contact faces.

3. The rubber stopper as claimed in claim 1, wherein the first contact face has one of a convex part and a concave part; and wherein the second contact face has the other of the convex part and the concave part to be fixed into the one of the convex part and the concave part.

4. A waterproof connector, comprising:

a connector housing into which the wires equipped with terminal clamps are inserted, wherein the connector housing includes a rubber stopper container into which the rubber stopper as claimed in claim 1 is inserted.

* * * * *